US010809638B2

(12) United States Patent
Miyamoto et al.

(10) Patent No.: US 10,809,638 B2
(45) Date of Patent: Oct. 20, 2020

(54) ELECTROPHOTOGRAPHIC PHOTOSENSITIVE MEMBER

(71) Applicant: KYOCERA Document Solutions Inc., Osaka (JP)

(72) Inventors: Eiichi Miyamoto, Osaka (JP); Yohei Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/521,427

(22) Filed: Jul. 24, 2019

(65) Prior Publication Data

US 2020/0041919 A1 Feb. 6, 2020

(30) Foreign Application Priority Data

Jul. 31, 2018 (JP) ..... 2018-143071

(51) Int. Cl.
*G03G 5/05* (2006.01)
*G03G 5/06* (2006.01)

(52) U.S. Cl.
CPC ..... *G03G 5/056* (2013.01); *G03G 5/0618* (2013.01); *G03G 5/0677* (2013.01); *G03G 5/0696* (2013.01); *G03G 5/06147* (2020.05)

(58) Field of Classification Search
CPC .... G03G 5/056; G03G 5/0614; G03G 5/0677; G03G 5/0618; G03G 5/06147
See application file for complete search history.

(56) References Cited

U.S. PATENT DOCUMENTS

2019/0235400 A1* 8/2019 Iwashita ..... G03G 5/0696
2019/0310562 A1* 10/2019 Tsurumi ..... G03G 15/75
(Continued)

FOREIGN PATENT DOCUMENTS

JP 2012-155202 A 8/2012
JP 2012208231 A * 10/2012
(Continued)

OTHER PUBLICATIONS

English language machine translation of JP 2012-208231 (Year: 2012).*
(Continued)

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer. The photosensitive layer is a single-layer photosensitive layer and contains a charge generating material, a hole transport material, an electron transport material, and a binder resin. A hole mobility $\mu_h$ is at least $1.00\times10^{-7}$ $cm^2/V/second$ and an electron mobility $\mu_e$ is at least $4.00\times10^{-8}$ $cm^2/V/second$ in the photosensitive layer as measured under conditions of a temperature of 23° C. and an electric field intensity of $1.50\times10^5$ V/cm. A ratio ($\mu_h/\mu_e$) of the hole mobility $\mu_h$ to the electron mobility $\mu_e$ is at least 1.0 and no greater than 50.0.

11 Claims, 2 Drawing Sheets

(56) References Cited

U.S. PATENT DOCUMENTS

| | | | | |
|---|---|---|---|---|
| 2019/0346780 | A1* | 11/2019 | Zhu | G03G 5/0614 |
| 2020/0041917 | A1* | 2/2020 | Fujita | G03G 5/0614 |
| 2020/0041923 | A1* | 2/2020 | Ishino | G03G 5/0609 |
| 2020/0041949 | A1* | 2/2020 | Ishino | G03G 5/0614 |
| 2020/0041950 | A1* | 2/2020 | Fujita | G03G 5/0614 |

FOREIGN PATENT DOCUMENTS

| | | | |
|---|---|---|---|
| JP | 2019078870 | A * | 5/2019 |
| WO | WO-2018079038 | A1 * | 5/2018 |

OTHER PUBLICATIONS

English language machine translation of JP 2019-078870 (Year: 2019).*

* cited by examiner

ELECTROPHOTOGRAPHIC PHOTOSENSITIVE MEMBER

INCORPORATION BY REFERENCE

The present application claims priority under 35 U.S.C. § 119 to Japanese Patent Application No. 2018-143071, filed on Jul. 31, 2018. The contents of this application are incorporated herein by reference in their entirety.

BACKGROUND

The present disclosure relates to an electrophotographic photosensitive member.

Electrophotographic photosensitive members are used as image bearing members of electrophotographic image forming apparatuses (for example, printers and multifunction peripherals). Electrophotographic photosensitive members each include a photosensitive layer. Examples of electrophotographic photosensitive members include single-layer electrophotographic photosensitive members and multi-layer electrophotographic photosensitive members. The single-layer electrophotographic photosensitive members each include a single-layer photosensitive layer having a charge generation function and a charge transport function. The multi-layer electrophotographic photosensitive members each include a photosensitive layer including a charge generating layer having a charge generation function and a charge transport layer having a charge transport function.

A photosensitive layer of an example of the electrophotographic photosensitive members contains an electron transport material offering at least a certain level of electron mobility.

SUMMARY

An electrophotographic photosensitive member according to an aspect of the present disclosure includes a conductive substrate and a photosensitive layer. The photosensitive layer is a single-layer photosensitive layer and contains a charge generating material, a hole transport material, an electron transport material, and a binder resin. A hole mobility $\mu_h$ is at least $1.00\times10^{-7}$ $cm^2/V/second$ and an electron mobility $\mu_e$ is at least $4.00\times10^{-8}$ $cm^2/V/second$ in the photosensitive layer as measured under conditions of a temperature of 23° C. and an electric field intensity of $1.50\times10^5$ V/cm. A ratio ($\mu_h/\mu_e$) of the hole mobility $\mu_h$ to the electron mobility $\mu_e$ is at least 1.0 and no greater than 50.0.

DETAILED DESCRIPTION

The following describes an embodiment of the present disclosure in detail. However, the present disclosure is not in any way limited by the following embodiment. Appropriate changes may be made when practicing the present disclosure so long as such changes do not deviate from the intended scope of the present disclosure. Although description is omitted as appropriate in some instances in order to avoid repetition, such omission does not limit the essence of the present disclosure.

The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, a halogen atom, an alkyl group having a carbon number of at least 1 and no greater than 8, an alkyl group having a carbon number of at least 1 and no greater than 5, an alkyl group having a carbon number of at least 1 and no greater than 4, and an alkoxy group having a carbon number of at least 1 and no greater than 4 each refer to the following, unless otherwise stated.

Examples of halogen atoms (halogen groups) include a fluorine atom (a fluoro group), a chlorine atom (a chloro group), a bromine atom (a bromo group), and an iodine atom (an iodine group).

An alkyl group having a carbon number of at least 1 and no greater than 8, an alkyl group having a carbon number of at least 1 and no greater than 5, and an alkyl group having a carbon number of at least 1 and no greater than 4 as used herein each refer to an unsubstituted straight chain or branched chain alkyl group. Examples of the alkyl group having a carbon number of at least 1 and no greater than 8 include a methyl group, an ethyl group, an n-propyl group, an isopropyl group, an n-butyl group, a sec-butyl group, a tert-butyl group, an n-pentyl group, an isopentyl group, a neopentyl group, a 1,1-dimethylpropyl group, a 1,2-dimethylpropyl group, a straight chain or branched chain hexyl group, a straight chain or branched chain heptyl group, and a straight chain or branched chain octyl group. Out of the chemical groups listed as examples of the alkyl group having a carbon number of at least 1 and no greater than 8, the chemical groups having a carbon number of at least 1 and no greater than 5 are examples of the alkyl group having a carbon number of at least 1 and no greater than 5, and the chemical groups having a carbon number of at least 1 and no greater than 4 are examples of the alkyl group having a carbon number of at least 1 and no greater than 4.

<Electrophotographic Photosensitive Member>

Figure 1:
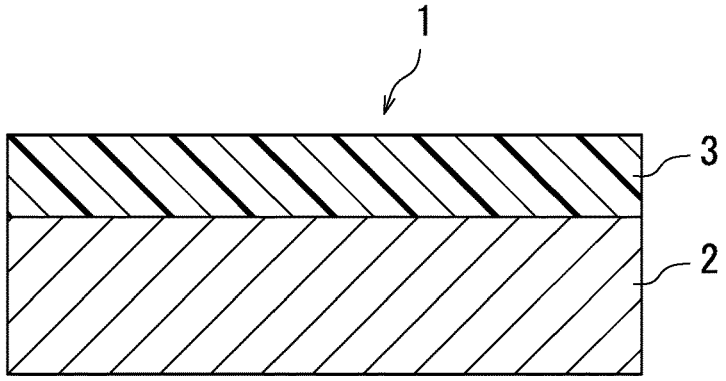
FIG. 1 is a partial cross-sectional view illustrating an example of a structure of an electrophotographic photosensitive member according to an embodiment of the present disclosure.
Figure 2:
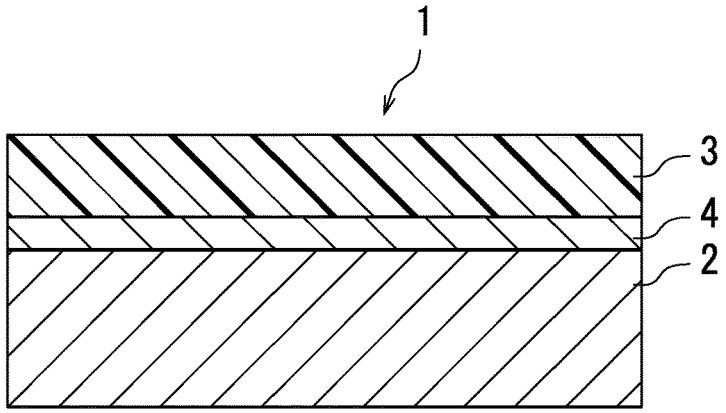
FIG. 2 is a partial cross-sectional view illustrating an example of the structure of the electrophotographic photosensitive member according to the embodiment of the present disclosure.
Figure 3:
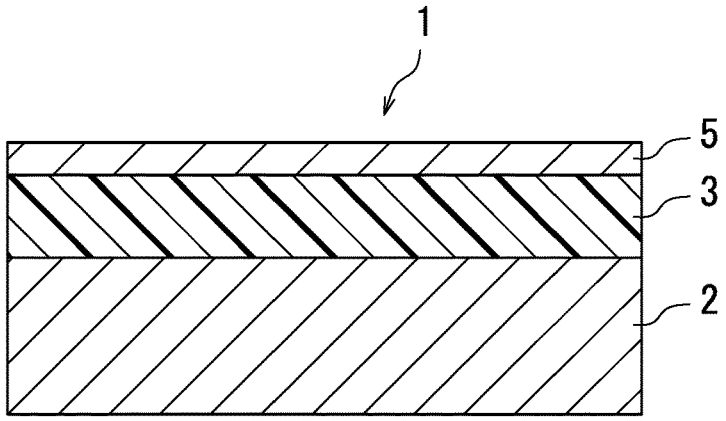
FIG. 3 is a partial cross-sectional view illustrating an example of the structure of the electrophotographic photosensitive member according to the embodiment of the present disclosure.

The following describes a structure of an electrophotographic photosensitive member (also referred to below as a photosensitive member) according to the embodiment of the present disclosure. FIGS. 1, 2, and 3 are partial cross-sectional views each illustrating a structure of a photosensitive member 1 according to the embodiment of the present disclosure.

As illustrated in FIG. 1, the photosensitive member 1 for example includes a conductive substrate 2 and a photosensitive layer 3. The photosensitive layer 3 is a single-layer (one-layer) photosensitive layer. The photosensitive member 1 is a single-layer electrophotographic photosensitive member including the single-layer photosensitive layer 3.

The photosensitive member 1 may include an intermediate layer 4 (undercoat layer) as well as the conductive substrate 2 and the photosensitive layer 3 as illustrated in FIG. 2. The intermediate layer 4 is disposed between the conductive substrate 2 and the photosensitive layer 3. The photosensitive layer 3 may be disposed directly on the conductive substrate 2 as illustrated in FIG. 1. Alternatively, the photosensitive layer 3 may be disposed indirectly on the conductive substrate 2 with the intermediate layer 4 therebetween as illustrated in FIG. 2. The intermediate layer 4 may be a single-layer intermediate layer or a multi-layer intermediate layer.

The photosensitive member 1 may include a protective layer 5 as well as the conductive substrate 2 and the photosensitive layer 3 as illustrated in FIG. 3. The protective layer 5 is disposed on the photosensitive layer 3. The protective layer 5 may be a single-layer protective layer or a multi-layer protective layer.

No particular limitations are placed on thickness of the photosensitive layer 3 so long as the thickness thereof is sufficient to enable the photosensitive layer 3 to function as a photosensitive layer. The photosensitive layer 3 preferably has a thickness of at least 5 μm and no greater than 100 μm, and more preferably at least 10 μm and no greater than 50 μm.

Through the above, the structure of the photosensitive member 1 has been described with reference to FIGS. 1 to 3. The following describes the photosensitive member in further detail.

[Conductive Substrate]

No particular limitations are placed on the conductive substrate other than being a conductive substrate that can be used in the photosensitive member. The conductive substrate can be a conductive substrate of which at least a surface portion is made from a conductive material. An example of the conductive substrate is a conductive substrate made from a conductive material. Another example of the conductive substrate is a conductive substrate having a conductive material coating. Examples of conductive materials that can be used include aluminum, iron, copper, tin, platinum, silver, vanadium, molybdenum, chromium, cadmium, titanium, nickel, palladium, indium, stainless steel, and brass. Any one of the conductive materials listed above may be used independently, or any two or more of the conductive materials listed above may be used in combination (for example, an alloy). Among the conductive materials listed above, aluminum or an aluminum alloy is preferable in terms of favorable charge transfer from the photosensitive layer to the conductive substrate.

The shape of the conductive substrate may be selected as appropriate to match the structure of an image forming apparatus in which the conductive substrate is to be used. The conductive substrate is for example a sheet-shaped conductive substrate or a drum-shaped conductive substrate. The thickness of the conductive substrate can be selected as appropriate in accordance with the shape of the conductive substrate.

[Photosensitive Layer]

The photosensitive layer contains a charge generating material, a hole transport material, an electron transport material, and a binder resin. The photosensitive layer may further contain another material such as an additive as an optional component.

A hole mobility $\mu_h$ is at least $1.00\times10^{-7}$ cm$^2$/V/second and an electron mobility $\mu_e$ is at least $4.00\times10^{-8}$ cm$^2$/V/second in the photosensitive layer as measured under conditions of a temperature of 23° C. and an electric field intensity of $1.50\times10^5$ V/cm. A ratio ($\mu_h/\mu_e$) of the hole mobility $\mu_h$ to the electron mobility $\mu_e$ is at least 1.0 and no greater than 50.0.

The present inventors found that charge generated in a photosensitive layer of a photosensitive member is efficiently transferred, and thus residual charge is reduced so long as the electron mobility $\mu_e$ in the photosensitive layer is at least a specified level, the hole mobility $\mu_h$ in the photosensitive layer is at least a specified level, and the electron mobility $\mu_e$ and the hole mobility $\mu_h$ are approximately at the same level. The present inventors then found that because of such a photosensitive layer, the photosensitive member has improved sensitivity and electrical characteristics such as transfer memory inhibiting ability and chargeability. However, a surface (a surface to be irradiated with irradiation light) of a photosensitive layer of a single-layer photosensitive member is typically charged with positive charge, and electrons from the charge generated through the light irradiation are used to neutralize the positive charge. Such charge tends to be generated mainly in the vicinity of the surface of the photosensitive layer. Accordingly, the electrons from the charge generated through the light irradiation travel a relatively short distance from the vicinity of the surface of the photosensitive layer to the surface of the photosensitive layer, whereas holes from the charge generated through the light irradiation tend to travel a relatively long distance from the vicinity of the surface of the photosensitive layer to the conductive substrate. The hole mobility $\mu_h$ can be higher than the electron mobility $\mu_e$ to a certain degree. The present disclosure was achieved based on the above-described finding and can provide a photosensitive member having excellent electrical characteristics by setting the electron mobility $\mu_e$, the hole mobility $\mu_h$, and the ratio ($\mu_h/\mu_e$) of the hole mobility $\mu_h$ to the electron mobility $\mu_e$ to respective specified ranges.

In terms of further improving electrical characteristics of the photosensitive member, the hole mobility $\mu_h$ in the photosensitive layer as measured under conditions of a temperature of 23° C. and an electric field intensity of $1.50\times10^5$ V/cm is preferably at least $4.00\times10^{-7}$ cm$^2$/V/second, and more preferably at least $1.00\times10^{-6}$ cm$^2$/V/second. In terms of further improving electrical characteristics of the photosensitive member, the hole mobility $\mu_h$ is preferably no greater than $1.00\times10^{-5}$ cm$^2$/V/second, and more preferably no greater than $5.00\times10^{-6}$ cm$^2$/V/second.

The hole mobility $\mu_h$ in the photosensitive layer can be adjusted mainly by varying the type and the amount of the hole transport material contained in the photosensitive layer. Specifically, increasing the amount of the hole transport material contained in the photosensitive layer tends to increase the hole mobility $\mu_h$. The use of a hole transport material capable of efficient hole transport tends to increase the hole mobility $\mu_h$.

In terms of further improving electrical characteristics of the photosensitive member, the electron mobility $\mu_e$ in the photosensitive layer as measured under conditions of a temperature of 23° C. and an electric field intensity of $1.50\times10^5$ V/cm is preferably at least $1.00\times10^{-7}$ cm$^2$/V/second, and more preferably at least $2.00\times10^{-7}$ cm$^2$/V/ second. In terms of further improving electrical characteristics of the photosensitive member, the electron mobility $\mu_e$ is preferably no greater than $1.00\times10^{-5}$ $cm^2/V/second$, more preferably no greater than $2.00\times10^{-6}$ $cm^2/V/second$, and still more preferably no greater than $5.00\times10^{-7}$ $cm^2/V/second$.

The electron mobility $\mu_e$ in the photosensitive layer can be adjusted mainly by varying the type and the amount of the electron transport material contained in the photosensitive layer. Specifically, increasing the amount of the electron transport material contained in the photosensitive layer tends to increase the electron mobility $\mu_e$. The use of an electron transport material capable of efficient electron transport tends to increase the electron mobility $\mu_e$.

In terms of further improving electrical characteristics of the photosensitive member, the ratio ($\mu_h/\mu_e$) of the hole mobility $\mu_h$ to the electron mobility $\mu_e$ in the photosensitive layer as measured under conditions of a temperature of 23° C. and an electric field intensity of $1.50\times10^5$ V/cm is preferably at least 1.0 and no greater than 10.0, and more preferably at least 1.0 and no greater than 5.0.

The electron mobility and the hole mobility in a photosensitive layer can be measured according to a method described below. First, a sample application liquid containing a binder resin, a hole transport material, an electron transport material, and a solvent is applied onto an aluminum substrate to form a sample layer (having a film thickness of 5 μm, for example). The binder resin, the hole transport material, and the electron transport material in the sample application liquid are of the same type as those in the measurement target photosensitive layer. No other materials such as a charge generating material and an additive are contained in the sample application liquid. The amount of the hole transport material and the amount of the electron transport material in the sample application liquid are adjusted so that the resulting sample layer is to contain the hole transport material in the same proportion (% by mass) as the measurement target photosensitive layer and contain the electron transport material in the same proportion (% by mass) as the measurement target photosensitive layer. The sample layer formed from the sample application liquid is equivalent to the measurement target photosensitive layer except that the measurement target photosensitive layer contains a charge generating material, an additive, and the like, whereas the sample layer contains the binder resin in an additional amount instead of the charge generating material, the additive, and the like. The additional amount of the binder resin in the sample layer is the same as the amounts of the charge generating material, the additive, and the like in the measurement target photosensitive layer. Then, a semi-transparent gold electrode is formed on the resulting sample layer by vacuum vapor deposition to prepare a sandwich cell. Next, the hole mobility $\mu_h$ and the electron mobility $\mu_e$ are determined by measuring the thus obtained sandwich cell by a time of flight (TOF) method under conditions of a temperature of 23° C. and an electric field intensity of $1.50\times10^5$ V/cm.

The following describes a charge generating material, a hole transport material, an electron transport material, a binder resin, and an additive, which is an optional component.

(Charge Generating Material)

No particular limitations are placed on the charge generating material other than being a charge generating material that can be used in the photosensitive member. Examples of charge generating materials that can be used include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (for example, selenium, selenium-tellurium, selenium-arsenic, cadmium sulfide, or amorphous silicon), pyrylium pigments, anthanthrone-based pigments, triphenylmethane-based pigments, threne-based pigments, toluidine-based pigments, pyrazoline-based pigments, and quinacridone-based pigments. Any one of the charge generating materials listed above may be used independently, or any two or more of the charge generating materials listed above may be used in combination.

Examples of phthalocyanine-based pigments that can be used include metal-free phthalocyanine and metal phthalocyanine. Metal-free phthalocyanine is for example represented by chemical formula (CG-1) shown below. Examples of metal phthalocyanine include titanyl phthalocyanine, hydroxygallium phthalocyanine, and chlorogallium phthalocyanine. Titanyl phthalocyanine is represented by chemical formula (CG-2) shown below. The phthalocyanine-based pigments may be crystalline or non-crystalline. No particular limitations are placed on the crystal structure (for example, α-form, β-form, Y-form, V-form, or II-form) of the phthalocyanine-based pigments, and phthalocyanine-based pigments having various different crystal structures may be used. Preferably, the charge generating material includes a compound represented by chemical formula (CG-1) or (CG-2) shown below.

(CG-1)

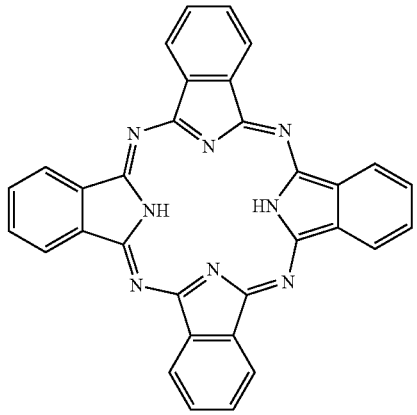

(CG-2)

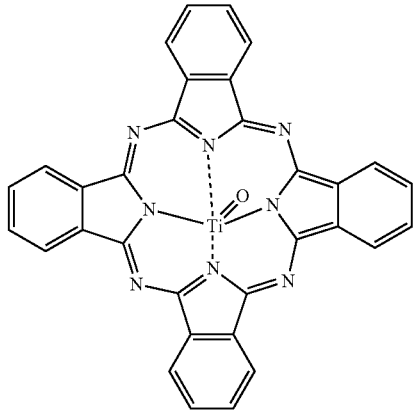

An example of crystalline metal-free phthalocyanine is metal-free phthalocyanine having an X-form crystal structure (also referred to below as X-form metal-free phthalocyanine). Examples of crystalline titanyl phthalocyanine include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively).

In a digital optical image forming apparatus (for example, a laser beam printer or facsimile machine that uses a light source such as a semiconductor laser), for example, a photosensitive member that is sensitive to a region of wavelengths of at least 700 nm is preferably used. Preferably, the charge generating material is a phthalocyanine-based pigment as offering high quantum yield in the region of wavelengths of at least 700 nm, more preferably metal-free phthalocyanine or titanyl phthalocyanine, still more preferably X-form metal-free phthalocyanine or Y-form titanyl phthalocyanine, and particularly preferably Y-form titanyl phthalocyanine.

Y-form titanyl phthalocyanine for example exhibits a main peak at a Bragg angle (2θ±0.2°) of 27.2° in a CuKα characteristic X-ray diffraction spectrum. The main peak in the CuKα characteristic X-ray diffraction spectrum refers to a peak having a highest or second highest intensity in a range of Bragg angles (2θ±0.2°) from 3° to 40°.

The following describes an example of a method for measuring the CuKα characteristic X-ray diffraction spectrum. A sample (titanyl phthalocyanine) is loaded into a sample holder of an X-ray diffraction spectrometer (for example, "RINT (registered Japanese trademark) 1100", product of Rigaku Corporation), and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is for example from 3° to 40° (start angle: 3°, stop angle: 40°), and the scanning rate is for example 10°/minute.

Y-form titanyl phthalocyanine is for example classified into the following three types (A) to (C) based on thermal characteristics in differential scanning calorimetry (DSC) spectra.

(A) Y-form titanyl phthalocyanine that exhibits a peak in a range of from 50° C. to 270° C. in a differential scanning calorimetry spectrum thereof, other than a peak resulting from vaporization of adsorbed water.

(B) Y-form titanyl phthalocyanine that does not exhibit a peak in a range of from 50° C. to 400° C. in a differential scanning calorimetry spectrum thereof, other than a peak resulting from vaporization of adsorbed water.

(C) Y-form titanyl phthalocyanine that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water.

Y-form titanyl phthalocyanine is preferable that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water. The Y-form titanyl phthalocyanine that exhibits such a peak is preferably Y-form titanyl phthalocyanine that exhibits a single peak in a range of higher than 270° C. and no higher than 400° C., and more preferably Y-form titanyl phthalocyanine that exhibits a single peak at 296° C.

The crystal structure of titanyl phthalocyanine can be inferred based on thermal characteristics indicated by a differential scanning calorimetry spectrum thereof. The following describes an example of a method for measuring a differential scanning calorimetry spectrum.

As an evaluation sample, a powder of titanyl phthalocyanine crystals is loaded into a sample pan, and a differential scanning calorimetry spectrum is measured using a differential scanning calorimeter (for example, "TAS-200 DSC8230D", product of Rigaku Corporation). The measurement range is for example from 40° C. to 400° C. The heating rate is for example 20° C./minute.

A photosensitive member included in an image forming apparatus that uses a short-wavelength laser light source (for example, a laser light source having a wavelength of at least 350 nm and no greater than 550 nm) preferably contains an anthanthrone-based pigment as a charge generating material.

The photosensitive layer preferably contains the charge generating material in a proportion of at least 0.2% by mass and no greater than 3.0% by mass, more preferably in a proportion of at least 0.5% by mass and no greater than 2.0% by mass, still more preferably in a proportion of at least 0.6% by mass and no greater than 1.7% by mass, and particularly preferably in a proportion of at least 0.8% by mass and no greater than 1.5% by mass.

The photosensitive layer preferably contains the charge generating material in an amount of at least 0.5 parts by mass and no greater than 20 parts by mass relative to 100 parts by mass of the binder resin, more preferably in an amount of at least 1.0 part by mass and no greater than 10 parts by mass, and particularly preferably in an amount of at least 1.5 parts by mass and no greater than 2.5 parts by mass.

In terms of further improving electrical characteristics of the photosensitive member, a xerographic gain in the photosensitive layer as measured under conditions of a temperature of 23° C. and an electric field intensity of $1.50\times10^5$ V/cm is preferably at least 10% and no greater than 45%, and more preferably at least 20% and no greater than 40%. Particularly preferably, the photosensitive layer contains the charge generating material in a proportion of at least 0.5% by mass and no greater than 2.0% by mass, and the xerographic gain is at least 10% and no greater than 45%.

The xerographic gain as used herein is defined as a ratio of $N_q$ to $N_p$, where $N_p$ is the number of photons irradiated onto the charged photosensitive layer, and $N_q$ is the number of surface charges, among charges generated through the irradiation, that have been neutralized as a result of traveling to the surface of the photosensitive layer.

The efficiency of charge transport in the photosensitive layer can be increased, and thus residual charge tends to be further reduced by setting the xerographic gain in the photosensitive layer to at least 10%. Excessive charge generation in the photosensitive layer can be inhibited, and thus residual charge tends to be further reduced by setting the xerographic gain in the photosensitive layer to no greater than 45%.

The xerographic gain in the photosensitive layer can be measured according to a method described below. First, the photosensitive member is charged under a condition of a temperature of 23° C. while the current flowing into the photosensitive member is controlled so as to give a specific charge potential (in a range of 100 V to 1,000 V including a specific electric field intensity). Next, the charge potential of the charged photosensitive member is measured at equal intervals (for example, at one-millisecond intervals) while the photosensitive member is irradiated with light for one second. The irradiation light has a wavelength (λ) of 780 nm and an optical intensity ($I_0$) of 1.0 μW/cm$^2$. Results of the measurement of the charge potential are differentiated with time to obtain values of decay rate, and a relationship between the xerographic gain and an electric field intensity E is determined in accordance with formulae (α) and (β) shown below based on ΔVmax, SPmax, and D, where ΔVmax is a largest value of the decay rate, SPmax is a surface potential at a time when ΔVmax is obtained, and D is a film thickness of the photosensitive layer. The thus determined relationship between the xerographic gain and the electric field intensity E is used to calculate the xerographic gain under a condition of an electric field intensity of $1.50\times10^5$ V/cm. In formula (α), εr represents a specific permittivity, ε0 represents a vacuum permittivity, e represents a quantum of charge, h represents a Planck's constant, and c represents a light speed. Note that the same method as described above can be employed for a photosensitive member provided with a protective layer on a photosensitive layer to measure the xerographic gain in the photosensitive layer.

$$\text{Xerographic gain}=(\Delta V\max\times\varepsilon r\times\varepsilon 0\times\lambda)/(D\times e\times I_0\times h\times c) \quad (\alpha)$$

$$E=SP\max/D \quad (\beta)$$

(Hole Transport Material)

Examples of hole transport materials that can be used include nitrogen-containing cyclic compounds and condensed polycyclic compounds. Examples of nitrogen-containing cyclic compounds and condensed polycyclic compounds that can be used include triphenylamine derivatives, diamine derivatives (specific examples include N,N,N',N'-tetraphenylbenzidine derivatives, N,N,N',N'-tetraphenylphenylenediamine derivatives, N,N,N',N'-tetraphenylnaphtylenediamine derivatives, di(aminophenylethenyl)benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. Any one of the hole transport materials listed above may be used independently, or any two or more of the hole transport materials listed above may be used in combination.

In terms of further improving electrical characteristics of the photosensitive member, the hole transport material preferably includes a compound represented by general formula (10) shown below (also referred to below as a hole transport material (10)).

(10)

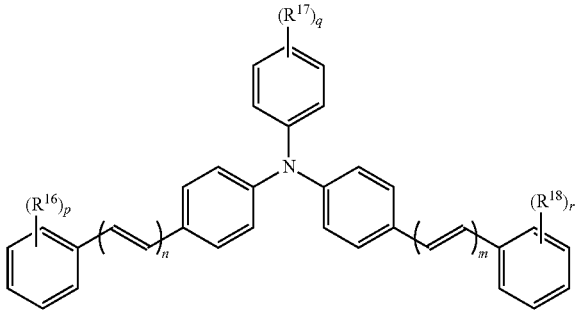

In general formula (10), $R^{16}$ to $R^{18}$ each represent, independently of one another, an alkyl group having a carbon number of at least 1 and no greater than 4 or an alkoxy group having a carbon number of at least 1 and no greater than 4. m and n each represent, independently of one another, an integer of at least 1 and no greater than 3. p and r each represent, independently of one another, 0 or 1. q represents an integer of at least 0 and no greater than 2.

In general formula (10), $R^{17}$ preferably represents an alkyl group having a carbon number of at least 1 and no greater than 4, and more preferably an n-butyl group.

In general formula (10), p and r each preferably represent 0. In general formula (10), q preferably represents 1.

In general formula (10), n and m each preferably represent 1 or 2, and more preferably 2.

Preferably, the hole transport material (10) is a compound represented by chemical formula (HT-1) shown below (also referred to below as a hole transport material (HT-1)).

(HT-1)

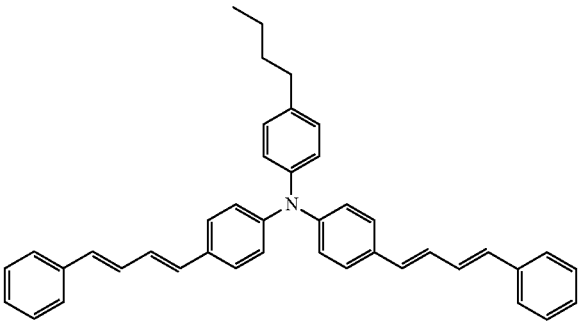

The photosensitive layer preferably contains the hole transport material in a proportion of at least 10.0% by mass and no greater than 40.0% by mass, more preferably in a proportion of at least 15.0% by mass and no greater than 35.0% by mass, and still more preferably in a proportion of at least 20.0% by mass and no greater than 30.0% by mass.

The photosensitive layer preferably contains the hole transport material in an amount of at least 20 parts by mass and no greater than 150 parts by mass relative to 100 parts by mass of the binder resin, more preferably in an amount of at least 35 parts by mass and no greater than 120 parts by mass, and still more preferably in an amount of at least 45 parts by mass and no greater than 70 parts by mass.

(Electron Transport Material)

Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds that can be used include diphenoquinone-based compounds, azoquinone-based compounds, anthraquinone-based compounds, naphthoquinone-based compounds, nitroanthraquinone-based compounds, and dinitroanthraquinone-based compounds. Any one of the electron transport materials listed above may be used independently, or any two or more of the electron transport materials listed above may be used in combination.

In terms of further improving electrical characteristics of the photosensitive member, preferably, the electron transport material includes a compound represented by general formula (1), (2), (3), or (4) shown below (the compounds represented by general formulae (1), (2), (3), and (4) are also referred to below as electron transport materials (1), (2), (3), and (4), respectively).

(1)

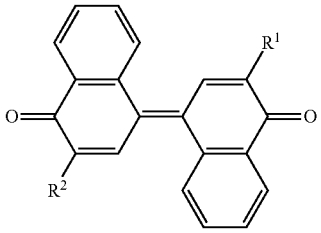

(2)

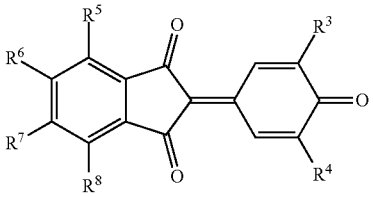

(3)

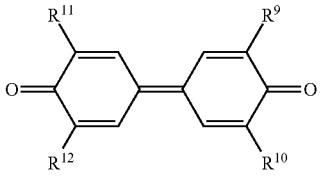

(4)

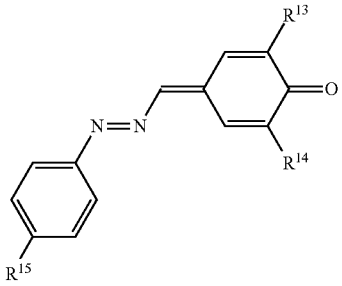

In general formulae (1) to (4), $R^1$ to $R^4$ and $R^9$ to $R^{14}$ each represent, independently of one another, an alkyl group having a carbon number of at least 1 and no greater than 8. $R^5$ to $R^8$ and $R^{15}$ each represent, independently of one another, a hydrogen atom, a halogen atom, or an alkyl group having a carbon number of at least 1 and no greater than 4.

In general formulae (1) to (4), the alkyl group that may be represented by $R^1$ to $R^4$ and $R^9$ to $R^{14}$ is preferably an alkyl group having a carbon number of at least 1 and no greater than 5, and more preferably a methyl group, a tert-butyl group, or a 1,1-dimethylpropyl group.

In general formulae (1) to (4), $R^5$ to $R^8$ and $R^{15}$ each preferably represent a hydrogen atom or a halogen atom, and more preferably a hydrogen atom or a chlorine atom.

In terms of further improving electrical characteristics of the photosensitive member, preferably, the electron transport materials (1) to (4) are compounds represented by chemical formulae (ET-1) to (ET-4) shown below (also referred to below as electron transport materials (ET-1) to (ET-4), respectively).

(ET-1)

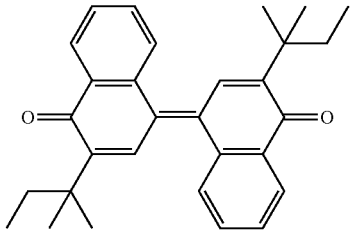

(ET-2)

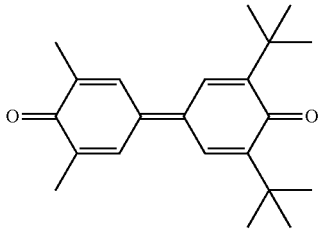

(ET-3)

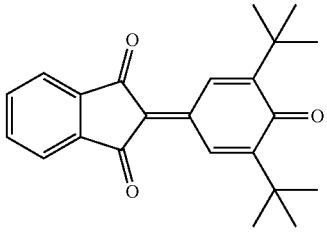

(ET-4)

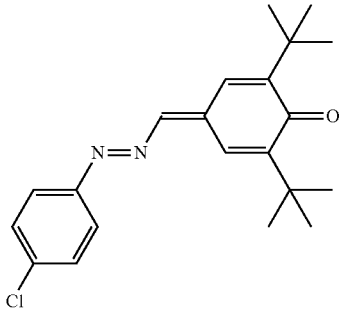

In the case of a photosensitive layer containing two or more electron transport materials, preferably, the photosensitive layer contains the electron transport materials (ET-1) and (ET-2) or contains the electron transport materials (ET-1) and (ET-3). In the case of a photosensitive layer containing two electron transport materials, preferably, the amounts of the two electron transport materials are substantially the same. Specifically, a ratio between the amount of one electron transport material contained in the photosensitive layer and the amount of the other electron transport material contained in the photosensitive layer is from 40:60 to 60:40.

The photosensitive layer preferably contains the electron transport material in a proportion of at least 10.0% by mass and no greater than 50.0% by mass, more preferably in a proportion of at least 15.0% by mass and no greater than 40.0% by mass, and still more preferably in a proportion of at least 20.0% by mass and no greater than 30.0% by mass.

The photosensitive layer preferably contains the electron transport material in an amount of at least 15 parts by mass and no greater than 160 parts by mass relative to 100 parts by mass of the binder resin, more preferably in an amount of at least 30 parts by mass and no greater than 100 parts by mass, and still more preferably in an amount of at least 40 parts by mass and no greater than 60 parts by mass.

(Binder Resin)

Examples of binder resins that can be used include thermoplastic resins, thermosetting resins, and photocurable resins. Examples of thermoplastic resins that can be used include polycarbonate resins, polyarylate resins, styrene-butadiene copolymers, styrene-acrylonitrile copolymers, styrene-maleate copolymers, acrylic acid polymers, styrene-acrylate copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins that can be used include silicone resins, epoxy resins, phenolic resins, urea resins, and melamine resins. Examples of photocurable resins that can be used include acrylic acid adducts of epoxy compounds and acrylic acid adducts of urethane compounds. The photosensitive layer may contain only one of the binder resins listed above or may contain two or more of the binder resins listed above.

Preferably, the binder resin includes a polyarylate resin including a repeating unit represented by general formula (20) shown below (also referred to below as a repeating unit (20)). The polyarylate resin including the repeating unit (20) is also referred to below as a polyarylate resin (PA).

(20)

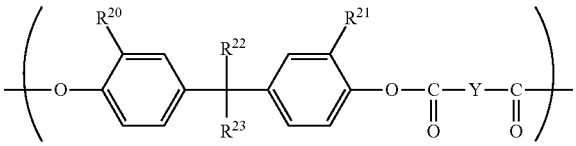

In general formula (20), $R^{20}$ and $R^{21}$ each represent, independently of one another, a hydrogen atom or an alkyl group having a carbon number of at least 1 and no greater than 4. $R^{22}$ and $R^{23}$ each represent, independently of one another, a hydrogen atom, a phenyl group, or an alkyl group having a carbon number of at least 1 and no greater than 4. $R^{22}$ and $R^{23}$ may be bonded to one another to form a divalent group represented by general formula (W) shown below. Y represents a divalent group represented by chemical formula (Y1), (Y2), (Y3), (Y4), (Y5), or (Y6) shown below.

(W)

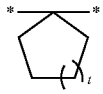

In general formula (W), t represents an integer of at least 1 and no greater than 3. Asterisks each represent a bond.

(Y1)

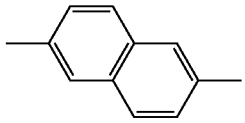

(Y2)

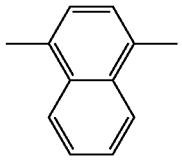

(Y3)

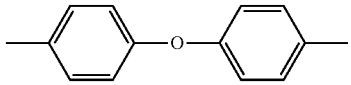

(Y4)

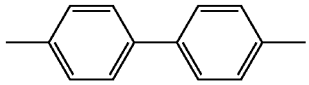

(Y5)

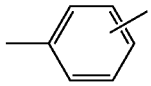

(Y6)

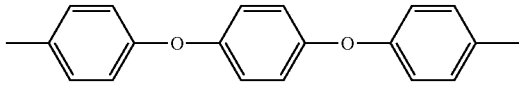

In general formula (20), $R^{20}$ and $R^{21}$ are each preferably an alkyl group having a carbon number of at least 1 and no greater than 4, and more preferably a methyl group.

In general formula (20), $R^{22}$ and $R^{23}$ are preferably bonded to one another to form a divalent group represented by general formula (W).

In general formula (20), preferably, Y is a divalent group represented by chemical formula (Y1) or (Y3).

In general formula (W), t preferably represents 2.

Preferably, the polyarylate resin (PA) only includes a repeating unit represented by general formula (20). However, the polyarylate resin (PA) may further include a different repeating unit. A ratio (mole fraction) of an amount by mole of the different repeating unit to the total amount by mole of all repeating units in the polyarylate resin (PA) is preferably no greater than 0.20, more preferably no greater than 0.10, and still more preferably 0.00. The polyarylate resin (PA) may only include one repeating unit (20) or may include a plurality of (for example, two) repeating units (20).

Note that in the present specification, the amount by mole of each repeating unit in the polyarylate resin (PA) is not a value obtained from one resin chain but a number average obtained from all molecules of the polyarylate resin (PA) (a plurality of resin chains) contained in the photosensitive layer. Furthermore, the amount by mole of each repeating unit can for example be calculated from a $^{1}$H-NMR spectrum of the polyarylate resin (PA) measured using a proton nuclear magnetic resonance spectrometer.

Preferably, the polyarylate resin (PA) includes at least one of repeating units represented by chemical formulae (20-a) and (20-b) shown below (also referred to below as repeating units (20-a) and (20-b), respectively), and more preferably includes both of the repeating units (20-a) and (20-b).

(Z)

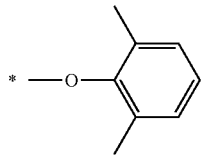

(20-a)

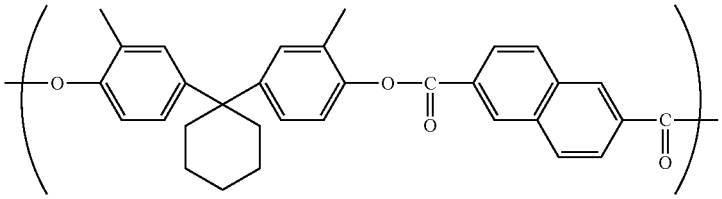

(20-b)

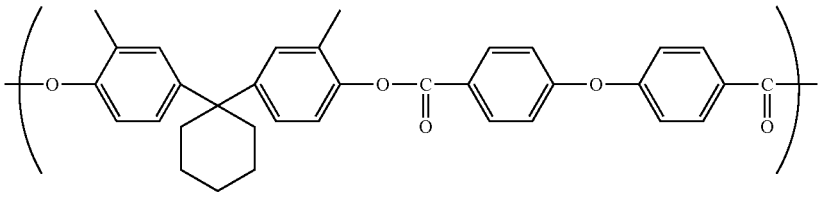

A resin including the repeating units (20-a) and (20-b) can for example be used as the polyarylate resin (PA). In the case of such a polyarylate resin (PA), no particular limitations are placed on the sequence of the repeating units (20-a) and (20-b). That is, the polyarylate resin (PA) including the repeating units (20-a) and (20-b) may be any of a random copolymer, a block copolymer, a periodic copolymer, or an alternating copolymer. Preferably, an amount by mole of the repeating unit (20-a) and an amount by mole of the repeating unit (20-b) in the polyarylate resin (PA) are substantially the same. Specifically, a ratio (mole fraction) between the amount by mole of the repeating unit (20-a) and the amount by mole of the repeating unit (20-b) in the polyarylate resin (PA) is from 49:51 to 51:49.

The polyarylate resin (PA) may have a terminal group represented by chemical formula (Z) shown below. An asterisk in chemical formula (Z) represents a bond. In the case of the polyarylate resin (PA) including the repeating unit (20-a), the repeating unit (20-b), and the terminal group represented by chemical formula (Z), the terminal group may be bonded to the repeating unit (20-a) or may be bonded to the repeating unit (20-b).

Preferably, the polyarylate resin (PA) is a polyarylate resin having a main chain represented by chemical formula (PA-1a) shown below and a terminal group represented by chemical formula (Z). Such a polyarylate resin (PA) is also referred to below as a polyarylate resin (PA-1). In chemical formula (PA-1a) shown below, the number appended to the lower right of each repeating unit indicates a ratio (mole fraction) of the amount by mole of the repeating unit to the total amount by mole of all repeating units included in the polyarylate resin (PA-1). The polyarylate resin (PA-1) may be any of a random copolymer, a block copolymer, a periodic copolymer, or an alternating copolymer.

(PA-1a)

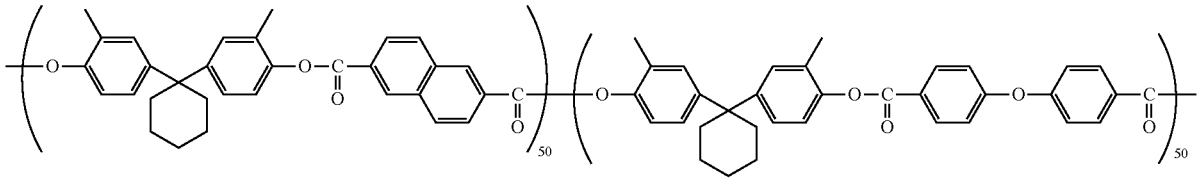

The binder resin preferably has a viscosity average molecular weight of at least 10,000, more preferably at least 20,000, and still more preferably at least 30,000. As a result of the viscosity average molecular weight of the binder resin being at least 10,000, the photosensitive member tends to have improved abrasion resistance. The binder resin preferably has a viscosity average molecular weight of no greater than 80,000, and more preferably no greater than 70,000. As a result of the viscosity average molecular weight of the binder resin being no greater than 80,000, the binder resin tends to readily dissolve in a solvent for photosensitive layer formation, facilitating formation of the photosensitive layer.

(Additive)

The photosensitive layer may contain an additive as an optional component. Examples of additives that can be used include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents. Examples of leveling agent that can be used include silicone oil. Only one of the additives listed above may be added to the photosensitive layer independently, or two or more of the additives listed above may be added to the photosensitive layer.

(Combination)

As a combination of the charge generating material and the electron transport material in the photosensitive layer, the following combinations are preferable.

A combination of metal-free phthalocyanine and the electron transport materials (ET-1) and (ET-2)

A combination of titanyl phthalocyanine and the electron transport materials (ET-1) and (ET-2)

A combination of titanyl phthalocyanine and the electron transport materials (ET-1) and (ET-3)

A combination of titanyl phthalocyanine and the electron transport material (ET-1)

A combination of titanyl phthalocyanine and the electron transport material (ET-2)

A combination of titanyl phthalocyanine and the electron transport material (ET-3)

A combination of titanyl phthalocyanine and the electron transport material (ET-4)

As a combination of the hole transport material and the electron transport material in the photosensitive layer, the following combinations are preferable.

A combination of the hole transport material (HT-1) and the electron transport materials (ET-1) and (ET-2)

A combination of the hole transport material (HT-1) and the electron transport materials (ET-1) and (ET-3)

A combination of the hole transport material (HT-1) and the electron transport material (ET-1)

A combination of the hole transport material (HT-1) and the electron transport material (ET-2)

A combination of the hole transport material (HT-1) and the electron transport material (ET-3)

A combination of the hole transport material (HT-1) and the electron transport material (ET-4)

More specifically, preferably, the hole transport material includes the hole transport material (HT-1); the photosensitive layer contains the hole transport material in a proportion of at least 18.0% by mass and no greater than 32.0% by mass; the electron transport material includes the electron transport material (ET-1), the electron transport material (ET-2), the electron transport material (ET-3), the electron transport material (ET-4), the electron transport materials (ET-1) and (ET-2), or the electron transport materials (ET-1) and (ET-3); and the photosensitive layer contains the electron transport material in a proportion of at least 21.0% by mass and no greater than 33.0% by mass.

[Intermediate Layer]

As described above, the photosensitive member may have an intermediate layer (for example, an undercoat layer). The intermediate layer for example contains inorganic particles and a resin that is used for the intermediate layer (intermediate layer resin). Provision of the intermediate layer can facilitate flow of current generated when the photosensitive member is irradiated with light and inhibit increasing resistance, while also maintaining insulation to a sufficient degree so as to inhibit occurrence of leakage current.

Examples of inorganic particles that can be used include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used independently, or any two or more types of the inorganic particles listed above may be used in combination. The inorganic particles may be surface-treated.

No particular limitations are placed on the intermediate layer resin other than being a resin that can be used to form the intermediate layer.

[Production Method]

<Production Method of Photosensitive Member>

The photosensitive member is for example produced by applying an application liquid for photosensitive layer formation onto a conductive substrate to form a liquid film and drying the liquid film. The application liquid for photosensitive layer formation is prepared by dissolving or dispersing a charge generating material, a hole transport material, an electron transport material, a binder resin, and an optional component as necessary in a solvent.

No particular limitations are placed on the solvent contained in the application liquid for photosensitive layer formation other than that the components of the application liquid should be soluble or dispersible in the solvent. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. In order to improve workability in production of the photosensitive member, a non-halogenated solvent (a solvent other than a halogenated hydrocarbon) is preferably used.

The application liquid for photosensitive layer formation is prepared by dispersing the components in the solvent by mixing. Mixing or dispersion can for example be performed using a bead mill, a roll mill, a ball mill, an attritor, a paint shaker, or an ultrasonic disperser.

The application liquid for photosensitive layer formation may for example contain a surfactant in order to improve dispersibility of the components.

No particular limitations are placed on the method by which the application liquid for photosensitive layer formation is applied other than being a method that enables uniform application of the application liquid for photosensitive layer formation on the conductive substrate. Examples of application methods that can be used include blade coating, dip coating, spray coating, spin coating, and bar coating.

No particular limitations are placed on the method by which the application liquid for photosensitive layer formation is dried other than being a method that enables evaporation of the solvent in the application liquid for photosensitive layer formation. An example of a method involves heat treatment (hot-air drying) using a high-temperature dryer or a reduced pressure dryer. The heat treatment temperature is for example from 40° C. to 150° C. The heat treatment time is for example from 3 minutes to 120 minutes.

Note that the production method of the photosensitive member may further include either or both of a process of forming the intermediate layer and a process of forming the protective layer as necessary. The process of forming the intermediate layer and the process of forming the protective layer are each performed according to a method appropriately selected from known methods.

The photosensitive member according to the embodiment of the present disclosure described above can be suitably used in various image forming apparatuses as having excellent electrical characteristics. The photosensitive member according to the embodiment of the present disclosure can be suitably used particularly in an image forming apparatus tending to have more residual charge. Specifically, the photosensitive member according to the embodiment of the present disclosure is suitably used as an image bearing member particularly in an image forming apparatus including a contact charger (for example, a charging roller) that applies a direct current voltage. The photosensitive member according to the embodiment of the present disclosure can also be suitably used particularly in a high-speed apparatus (for example, an image forming apparatus offering a process time of no greater than 200 milliseconds from static elimination to charging).

EXAMPLES

The following provides more specific description of the present disclosure through use of Examples. However, the present disclosure is not in any way limited to the scope of Examples.

<Materials for Formation of Photosensitive Layer>

Charge generating materials, a hole transport material, electron transport materials, and a binder resin described below were prepared as materials for formation of photosensitive layers of photosensitive members.

(Charge Generating Material)

X-form metal-free phthalocyanine and Y-form titanyl phthalocyanine were prepared as the charge generating materials. The X-form metal-free phthalocyanine was the metal-free phthalocyanine represented by chemical formula (CG-1) described in association with the embodiment and having an X-form crystal structure. The Y-form titanyl phthalocyanine was the titanyl phthalocyanine represented by chemical formula (CG-2) described in association with the embodiment and having a Y-form crystal structure. The Y-form titanyl phthalocyanine did not exhibit a peak in a range of from 50° C. to 270° C. and exhibited a peak in a range of higher than 270° C. and no higher than 400° C. (specifically, a single peak at 296° C.) in a differential scanning calorimetry spectrum thereof, other than a peak resulting from vaporization of adsorbed water.

(Hole Transport Material)

The hole transport material (HT-1) described in association with the embodiment was prepared as the hole transport material.

(Electron Transport Material)

The electron transport materials (ET-1) to (ET-4) described in association with the embodiment were prepared as the electron transport materials.

(Binder Resin)

The polyarylate resin (PA-1) described in association with the embodiment was prepared as the binder resin. The polyarylate resin (PA-1) had a viscosity average molecular weight of 60,000.

<Production of Photosensitive Member>

Each of photosensitive members (A-1) to (A-21) and (B-1) to (B-12) was produced using materials for forming a photosensitive layer thereof.

(Production of Photosensitive Member (A-1))

A vessel was charged with 3.3 parts by mass of the charge generating material (CG-1), 36.5 parts by mass of the hole transport material (HT-1), 31.4 parts by mass of the electron transport material (ET-1), 31.4 parts by mass of the electron transport material (ET-2), 100 parts by mass of the polyarylate resin (PA-1) as the binder resin, 0.02 parts by mass of silicone oil ("KF96", product of Shin-Etsu Chemical Co., Ltd.) as a leveling agent, and 800 parts by mass of tetrahydrofuran as a solvent. The vessel contents were mixed for 50 hours using a ball mill to disperse the materials (the charge generating material, the hole transport material, the two electron transport materials, the binder resin, and the leveling agent) in the solvent. Thus, an application liquid for photosensitive layer formation was obtained. The application liquid for photosensitive layer formation was applied onto a conductive substrate—an aluminum drum-shaped support (diameter: 30 mm, total length: 247.5 mm)—by dip coating to form a liquid film. The liquid film was hot-air dried at 100° C. for 40 μminutes. Through the above, a single-layer photosensitive layer (film thickness: 30 μm) was formed on the conductive substrate. As a result, the photosensitive member (A-1) was obtained.

(Production of Photosensitive Members (A-2) to (A-21) and (B-1) to (B-12))

Each of the photosensitive members (A-2) to (A-21) and (B-1) to (B-12) was produced according to the same method as in the production of the photosensitive member (A-1) in all aspects other than the following changes. The components of type and in amounts as shown in Table 1 or 2 below were used in the production of each of the photosensitive members (A-2) to (A-21) and (B-1) to (B-12), while the charge generating material, the hole transport material, the two electron transport materials, the binder resin, and the leveling agent of type and in amounts described above were used in the production of the photosensitive member (A-1).

For convenience, the photosensitive members (A-1) to (A-6) and (B-1) to (B-5) may be referred to collectively as Group A, the photosensitive members (A-7) to (A-11) and (B-6) to (B-8) may be referred to collectively as Group B, the photosensitive members (A-12) to (A-14) and (B-9) to (B-11) may be referred to collectively as Group C. The photosensitive members belonging to the same group contain the same components and are different from one another mainly in the amounts of the hole transport material and the electron transport materials.

In Tables 1 and 2, "CGM" means "charge generating material", "HTM" means "hole transport material", "ETM A" means "first electron transport material", "ETM B" means "second electron transport material", "ETM A+B" means "total of first and second electron transport materials", and "Resin (PA-1)" means "polyarylate resin (PA-1)". "-" means that the component is not contained.

TABLE 1

| | | Photo-sensitive member | Components | | | | Component percentages (% by mass) | | | | | Component amounts (parts by mass) | | | | | | |
|---|---|---|---|---|---|---|---|---|---|---|---|---|---|---|---|---|---|---|
| | | | CGM | HTM | ETM A | ETM B | CGM | HTM | ETM A | ETM B | ETM A + B | CGM | HTM | ETM A | ETM B | ETM A + B | Leveling agent | Resin (PA-1) |
| A | Comparative Example 1 | B-1 | CG-1 | HT-1 | ET-1 | ET-2 | 1.6 | 18.1 | 18.1 | 18.1 | 36.2 | 3.7 | 41.1 | 41.1 | 41.1 | 82.2 | 0.02 | 100 |
| | Comparative Example 2 | B-2 | CG-1 | HT-1 | ET-1 | ET-2 | 1.6 | 16.3 | 16.3 | 16.3 | 32.6 | 3.3 | 32.8 | 32.8 | 32.8 | 65.6 | 0.02 | 100 |
| | Example 1 | A-1 | CG-1 | HT-1 | ET-1 | ET-2 | 1.6 | 18.0 | 15.5 | 15.5 | 31.0 | 3.3 | 36.5 | 31.4 | 31.4 | 62.8 | 0.02 | 100 |
| | Example 2 | A-2 | CG-1 | HT-1 | ET-1 | ET-2 | 1.6 | 21.0 | 15.0 | 15.0 | 30.0 | 3.4 | 44.3 | 31.7 | 31.7 | 63.4 | 0.02 | 100 |
| | Example 3 | A-3 | CG-1 | HT-1 | ET-1 | ET-2 | 1.6 | 21.8 | 10.9 | 10.9 | 21.8 | 3.0 | 40.0 | 20.0 | 20.0 | 40.0 | 0.02 | 100 |
| | Example 4 | A-4 | CG-1 | HT-1 | ET-1 | ET-2 | 1.6 | 27.2 | 13.6 | 13.6 | 27.2 | 3.7 | 61.7 | 30.9 | 30.9 | 61.8 | 0.02 | 100 |
| | Example 5 | A-5 | CG-1 | HT-1 | ET-1 | ET-2 | 1.6 | 29.0 | 10.5 | 10.5 | 21.0 | 3.3 | 60.0 | 21.7 | 21.7 | 43.4 | 0.02 | 100 |
| | Example 6 | A-6 | CG-1 | HT-1 | ET-1 | ET-2 | 1.6 | 26.4 | 6.5 | 6.5 | 13.0 | 2.7 | 44.8 | 11.0 | 11.0 | 22.0 | 0.02 | 100 |
| | Comparative Example 3 | B-3 | CG-1 | HT-1 | ET-1 | ET-2 | 1.6 | 29.1 | 7.3 | 7.3 | 14.6 | 3.0 | 53.3 | 13.3 | 13.3 | 26.6 | 0.02 | 100 |
| | Comparative Example 4 | B-4 | CG-1 | HT-1 | ET-1 | ET-2 | 1.8 | 32.5 | 8.1 | 8.1 | 16.2 | 3.6 | 65.7 | 16.4 | 16.4 | 32.8 | 0.02 | 100 |
| | Comparative Example 5 | B-5 | CG-1 | HT-1 | ET-1 | ET-2 | 1.6 | 36.2 | 9.1 | 9.1 | 18.2 | 3.7 | 82.3 | 20.6 | 20.6 | 41.2 | 0.02 | 100 |
| B | Comparative Example 6 | B-6 | CG-2 | HT-1 | ET-1 | ET-2 | 1.0 | 15.7 | 20.2 | 20.2 | 40.4 | 2.3 | 36.4 | 46.9 | 46.9 | 93.8 | 0.02 | 100 |
| | Example 7 | A-7 | CG-2 | HT-1 | ET-1 | ET-2 | 1.0 | 18.0 | 15.5 | 15.5 | 31.0 | 2.0 | 36.0 | 31.0 | 31.0 | 62.0 | 0.02 | 100 |
| | Example 8 | A-8 | CG-2 | HT-1 | ET-1 | ET-2 | 1.0 | 29.9 | 20.2 | 20.2 | 40.4 | 3.5 | 104.2 | 70.2 | 70.2 | 140.4 | 0.02 | 100 |
| | Example 9 | A-9 | CG-2 | HT-1 | ET-1 | ET-2 | 1.0 | 21.6 | 11.7 | 11.7 | 23.4 | 1.8 | 39.9 | 21.5 | 21.5 | 43.0 | 0.02 | 100 |
| | Example 10 | A-10 | CG-2 | HT-1 | ET-1 | ET-2 | 1.0 | 26.0 | 10.5 | 10.5 | 21.0 | 1.9 | 50.0 | 20.2 | 20.2 | 40.4 | 0.02 | 100 |
| | Example 11 | A-11 | CG-2 | HT-1 | ET-1 | ET-2 | 1.0 | 32.0 | 10.5 | 10.5 | 21.0 | 2.2 | 69.6 | 22.8 | 22.8 | 45.6 | 0.02 | 100 |
| | Comparative Example 7 | B-7 | CG-2 | HT-1 | ET-1 | ET-2 | 1.0 | 33.5 | 10.0 | 10.0 | 20.0 | 2.2 | 73.6 | 22.0 | 22.0 | 44.0 | 0.02 | 100 |
| | Comparative Example 8 | B-8 | CG-2 | HT-1 | ET-1 | ET-2 | 1.0 | 36.0 | 9.0 | 9.0 | 18.0 | 2.2 | 80.0 | 20.0 | 20.0 | 40.0 | 0.02 | 100 |

TABLE 2

| | | Photo-sensitive member | Components | | | | Component percentages (% by mass) | | | | | Component amounts (parts by mass) | | | | | | |
|---|---|---|---|---|---|---|---|---|---|---|---|---|---|---|---|---|---|---|
| | | | CGM | HTM | ETM A | ETM B | CGM | HTM | ETM A | ETM B | ETM A + B | CGM | HTM | ETM A | ETM B | ETM A + B | Leveling agent | Resin (PA-1) |
| C | Comparative Example 9 | B-9 | CG-2 | HT-1 | ET-1 | ET-3 | 1.0 | 17.0 | 18.1 | 18.1 | 36.2 | 2.2 | 37.2 | 39.6 | 39.6 | 79.2 | 0.02 | 100 |
| | Example 12 | A-12 | CG-2 | HT-1 | ET-1 | ET-3 | 1.0 | 19.0 | 16.5 | 16.5 | 33.0 | 2.1 | 40.4 | 35.1 | 35.1 | 70.2 | 0.02 | 100 |
| | Example 13 | A-13 | CG-2 | HT-1 | ET-1 | ET-3 | 1.0 | 26.0 | 11.0 | 11.0 | 22.0 | 1.9 | 51.0 | 21.6 | 21.6 | 43.2 | 0.02 | 100 |
| | Example 14 | A-14 | CG-2 | HT-1 | ET-1 | ET-3 | 1.0 | 32.0 | 11.0 | 11.0 | 22.0 | 2.2 | 71.1 | 24.5 | 24.5 | 49.0 | 0.02 | 100 |
| | Comparative Example 10 | B-10 | CG-2 | HT-1 | ET-1 | ET-3 | 1.0 | 33.5 | 10.5 | 10.5 | 21.0 | 2.2 | 75.3 | 23.6 | 23.6 | 47.2 | 0.02 | 100 |
| | Comparative Example 11 | B-11 | CG-2 | HT-1 | ET-1 | ET-3 | 1.0 | 36.0 | 9.0 | 9.0 | 18.0 | 2.2 | 80.0 | 20.0 | 20.0 | 40.0 | 0.02 | 100 |
| | Example 15 | A-15 | CG-2 | HT-1 | ET-1 | — | 1.0 | 26.0 | 22.0 | — | 22.0 | 1.9 | 51.0 | 43.1 | — | 43.1 | 0.02 | 100 |
| | Example 16 | A-16 | CG-2 | HT-1 | ET-2 | — | 1.0 | 26.0 | 22.0 | — | 22.0 | 1.9 | 51.0 | 43.1 | — | 43.1 | 0.02 | 100 |
| | Example 17 | A-17 | CG-2 | HT-1 | ET-3 | — | 1.0 | 26.0 | 22.0 | — | 22.0 | 1.9 | 51.0 | 43.1 | — | 43.1 | 0.02 | 100 |
| | Example 18 | A-18 | CG-2 | HT-1 | ET-4 | — | 1.0 | 26.0 | 22.0 | — | 22.0 | 1.9 | 51.0 | 43.1 | — | 43.1 | 0.02 | 100 |
| | Example 19 | A-19 | CG-2 | HT-1 | ET-1 | ET-3 | 0.7 | 19.4 | 14.5 | 14.5 | 29.0 | 1.4 | 38.1 | 28.4 | 28.4 | 56.8 | 0.02 | 100 |
| | Example 20 | A-20 | CG-2 | HT-1 | ET-1 | ET-3 | 1.0 | 19.3 | 14.4 | 14.4 | 28.8 | 2.2 | 37.9 | 28.2 | 28.2 | 56.4 | 0.02 | 100 |
| | Example 21 | A-21 | CG-2 | HT-1 | ET-1 | ET-3 | 1.5 | 19.1 | 14.3 | 14.3 | 28.6 | 3.0 | 37.7 | 28.1 | 28.1 | 56.2 | 0.02 | 100 |
| | Comparative Example 12 | B-12 | CG-2 | HT-1 | ET-1 | — | 1.6 | 29.1 | 14.6 | — | 14.6 | 3.0 | 53.3 | 26.6 | — | 26.6 | 0.02 | 100 |

<Measurement of Hole Mobility and Electron Mobility in Photosensitive Layer>

With respect to each of the photosensitive members (A-1) to (A-21) and (B-1) to (B-12), the hole mobility and the electron mobility in the photosensitive layer of the photosensitive member were measured. First, a sample layer was formed as a measurement sample which was equivalent to the photosensitive layer of the photosensitive member except that the sample layer contained the binder resin in an additional amount instead of the charge generating material and the leveling agent. The additional amount of the binder resin in the sample layer was the same as the amounts of the charge generating material and the leveling agent in the photosensitive layer. A sample application liquid containing only the hole transport material, the electron transport material(s), the binder resin, and the solvent was used for the formation of the sample layer. The binder resin, the hole transport material, and the electron transport material(s) in the sample application liquid were of the same type as those in the application liquid for photosensitive layer formation used in the production of the photosensitive member. The charge generating material and the leveling agent contained in the application liquid for photosensitive layer formation used in the production of the photosensitive member were not contained in the sample application liquid. Instead, the amount of the binder resin in the sample application liquid was increased to make up for the amounts (parts by mass) of the charge generating material and the leveling agent. For example, the sample application liquid corresponding to the photosensitive member (A-1) had a composition consisting of 36.5 parts by mass of the hole transport material (HT-1), 31.4 parts by mass of the electron transport material (ET-1), 31.4 parts by mass of the electron transport material (ET-2), 103.302 parts by mass of the polyarylate resin (PA-1) as the binder resin, and 800 parts by mass of tetrahydrofuran as the solvent.

The sample application liquid was applied onto an aluminum substrate using a wire bar so as to give a liquid film having a thickness of 5 μm, and then the liquid film was dried. Thus, a thin film (the sample layer) was formed. Thereafter, a semi-transparent gold electrode was formed on the thin film by vacuum vapor deposition to prepare a sandwich cell. The hole mobility $\mu_h$ and the electron mobility $\mu_e$ were determined by measuring the thus obtained sandwich cell by a common time of flight (TOF) method under conditions of a temperature of 23° C. and an electric field intensity of $1.50\times10^5$ V/cm. The hole mobility $\mu_h$ and the electron mobility $\mu_e$ of the sandwich cell measured as described above were taken to be the hole mobility $\mu_h$ and the electron mobility $\mu_e$ of the photosensitive layer of the photosensitive member. Measurement results of the photosensitive members are shown in Table 3 below.

In the measurement of the hole mobility $\mu_h$ and the electron mobility $\mu_e$ by the TOF method, pulsed light (wavelength: 337 nm) was irradiated onto the thin film through the semi-transparent gold electrode while a voltage was applied between the electrodes (the semi-transparent gold electrode and the aluminum substrate) of the sandwich cell. A nitrogen laser generator ("ULC-50", product of Usho) was used as a source of the pulsed light. Changes in the current over time due to the pulsed light irradiation were measured using a storage oscilloscope ("TS-8123", product of IWATSU ELECTRIC CO., LTD). The changes in the current over time were plotted on a double logarithmic graph, and a transit time (tr, unit: second) was determined based on a slope change on the graph. Charge mobility was calculated by substituting the film thickness (L) of the thin film, the transit time (tr), and the voltage (V) into the following relational expression (μ).

$$\text{Charge mobility}=(L/tr)/(V/L) \quad (\mu)$$

<Measurement of Xerographic Gain>

With respect to each of the photosensitive members (A-1) to (A-21) and (B-1) to (B-12), the xerographic gain of the photosensitive layer of the photosensitive member was measured using a drum sensitivity test device (product of Gen-Tech, Inc.). First, the photosensitive member was charged under a condition of a temperature of 23° C. while the current flowing into the photosensitive member was controlled so as to give a specific charge potential (100 V to 1,000 V). The charge potential of the charged photosensitive member was measured at equal intervals (at one-millisecond intervals) while the photosensitive member was irradiated with light for one second. The irradiation light had a wavelength (λ) of 780 nm and an optical intensity ($I_0$) of 1.0 μW/cm$^2$. Results of the measurement of the charge potential were differentiated with time to obtain values of decay rate, and a relationship between the xerographic gain and the electric field intensity E was determined in accordance with formulae (α) and (β) shown below based on ΔVmax, SPmax, and D, where ΔVmax is a largest value of the decay rate, SPmax is a surface potential at a time when ΔVmax was obtained, and D is a film thickness of the photosensitive layer. In this measurement, the charge potential was varied so as to include an electric field intensity of $1.50\times10^5$ V/cm, and the above-described steps were repeated. The thus determined relationship between the xerographic gain and the electric field intensity E was used to calculate the xerographic gain under a condition of an electric field intensity of $1.50\times10^5$ V/cm. Measurement results of the photosensitive members are shown in Table 3 below. In formula (α), εr represents a specific permittivity, ε0 represents a vacuum permittivity, e represents a quantum of charge, h represents a Planck's constant, and c represents a light speed.

$$\text{Xerographic gain}=(\Delta V\max\times\varepsilon r\times\varepsilon 0\times\lambda)/(D\times e\times I_0\times h\times c) \quad (\alpha)$$

$$E=SP\max/D \quad (\beta)$$

<Measurement of Electrical Characteristics>

With respect to each of the photosensitive members (A-1) to (A-21) and (B-1) to (B-12), electrical characteristics (post-irradiation potential, transfer memory potential, and charging current) were measured. The electrical characteristics were measured under environmental conditions of a temperature of 23° C. and a relative humidity of 50%. A color image forming apparatus ("FS-C5250DN", product of KYOCERA Document Solutions Inc.) was used as an evaluation apparatus. This image forming apparatus included a contact charging roller that applies a direct current voltage. Measurement results of the photosensitive members are shown in Table 3 below.

In the measurement of the post-irradiation potential, first, the photosensitive member was mounted in the evaluation apparatus and charged to a surface potential (in a non-exposed portion) of +570 V±10 V by adjusting the voltage applied to the charging roller. Next, the photosensitive member was irradiated with light using, as an irradiation light source, a laser diode in the evaluation apparatus. The irradiation light had a wavelength of 780 nm and an optical energy of 1.16 μJ/cm$^2$. After the light irradiation, the surface potential of the photosensitive member was measured at a point thereon adjacent to a developing section, and the measured surface potential was taken to be a post-irradiation potential ($V_L$, unit: +V). A smaller value of the post-irradiation potential indicates better sensitivity. The photosensitive member is determined to have good sensitivity if the value of the post-irradiation potential is no greater than 140 V and is determined to have poor sensitivity if the value of the post-irradiation potential is greater than 140 V.

In the measurement of the transfer memory potential, first, the photosensitive member was mounted in the evaluation apparatus and charged to a surface potential (in a non-exposed portion) of +570 V±10 V by adjusting the voltage applied to the charging roller. Next, a difference ($V_{tcon}-V_0$) between a surface potential $V_0$ of the photosensitive member after transfer with a transfer current set to 0 μA (with a transfer function off) and a surface potential $V_{tcon}$ of the photosensitive member after transfer with application of a transfer current of −20 μA. The thus measured difference was taken to be a transfer memory potential ($\Delta V_{tc}$). A smaller absolute value of the transfer memory potential indicates a higher degree of inhibition of transfer memory. The photosensitive member is determined to have good transfer memory inhibiting ability if the absolute value of the transfer memory potential is no greater than 10 V and is determined to have poor transfer memory inhibiting ability if the absolute value of the transfer memory potential is greater than 10 V.

In the measurement of the charging current, first, the photosensitive member was mounted in the evaluation apparatus and charged to a surface potential (in a non-exposed portion) of +570 V±10V by adjusting the voltage applied to the charging roller. The current flowing through the charging roller during the charging of the photosensitive member was taken to be a charging current (Idc, unit: μA). A smaller value of the charging current indicates better chargeability. The photosensitive member is determined to have good chargeability if the value of the charging current is no greater than 35 μA and is determined to have poor chargeability if the value of the charging current is greater than 35 μA.

In Table 3, $\mu_h$ means hole mobility in photosensitive layer, $\mu_e$ means electron mobility in photosensitive layer, XGain means xerographic gain of photosensitive layer, $V_L$ means post-irradiation potential, $\Delta V_{tc}$ means transfer memory potential, and Idc means charging current.

TABLE 3

| | | Photo-sensitive member | Mobility $\mu_h$ [cm²/V/second] | Mobility $\mu_e$ [cm²/V/second] | $\mu_h/\mu_e$ | X gain [%] | Electrical characteristics $V_L$ [+V] | $\Delta V_{tc}$ [V] | Idc [μA] |
|---|---|---|---|---|---|---|---|---|---|
| A | Comparative Example 1 | B-1 | $4.17 \times 10^{-7}$ | $6.47 \times 10^{-7}$ | 0.6 | 25.0 | 240 | −18 | 39 |
| | Comparative Example 2 | B-2 | $3.04 \times 10^{-7}$ | $4.19 \times 10^{-7}$ | 0.7 | 29.5 | 190 | −14 | 37 |
| | Example 1 | A-1 | $4.09 \times 10^{-7}$ | $3.50 \times 10^{-7}$ | 1.2 | 32.2 | 135 | −5 | 31 |
| | Example 2 | A-2 | $6.84 \times 10^{-7}$ | $3.11 \times 10^{-7}$ | 2.2 | 32.3 | 129 | −3 | 30 |
| | Example 3 | A-3 | $7.92 \times 10^{-7}$ | $1.19 \times 10^{-7}$ | 6.6 | 32.1 | 126 | −2 | 29 |
| | Example 4 | A-4 | $1.97 \times 10^{-6}$ | $2.23 \times 10^{-7}$ | 8.8 | 32.6 | 122 | −2 | 29 |
| | Example 5 | A-5 | $2.70 \times 10^{-6}$ | $1.08 \times 10^{-7}$ | 25.0 | 32.4 | 120 | −3 | 30 |
| | Example 6 | A-6 | $1.73 \times 10^{-6}$ | $4.21 \times 10^{-8}$ | 41.0 | 32.1 | 118 | −7 | 31 |
| | Comparative Example 3 | B-3 | $2.76 \times 10^{-6}$ | $5.06 \times 10^{-8}$ | 54.5 | 32.2 | 112 | −14 | 36 |
| | Comparative Example 4 | B-4 | $4.91 \times 10^{-6}$ | $6.17 \times 10^{-8}$ | 79.6 | 32.5 | 105 | −22 | 42 |
| | Comparative Example 5 | B-5 | $9.33 \times 10^{-6}$ | $7.69 \times 10^{-8}$ | 121.4 | 32.7 | 98 | −31 | 56 |
| B | Comparative Example 6 | B-6 | $2.73 \times 10^{-7}$ | $1.05 \times 10^{-6}$ | 0.3 | 30.1 | 160 | +63 | 30 |
| | Example 7 | A-7 | $4.09 \times 10^{-7}$ | $3.50 \times 10^{-7}$ | 1.2 | 36.8 | 102 | −3 | 26 |
| | Example 8 | A-8 | $3.16 \times 10^{-6}$ | $1.05 \times 10^{-6}$ | 3.0 | 38.2 | 100 | −2 | 24 |
| | Example 9 | A-9 | $7.54 \times 10^{-7}$ | $1.41 \times 10^{-7}$ | 5.3 | 36.3 | 95 | −2 | 24 |
| | Example 10 | A-10 | $1.61 \times 10^{-6}$ | $1.08 \times 10^{-7}$ | 15.0 | 36.6 | 90 | −2 | 24 |
| | Example 11 | A-11 | $4.52 \times 10^{-6}$ | $1.08 \times 10^{-7}$ | 41.9 | 37.4 | 92 | −10 | 25 |
| | Comparative Example 7 | B-7 | $5.84 \times 10^{-6}$ | $9.59 \times 10^{-8}$ | 60.9 | 37.8 | 90 | −16 | 29 |
| | Comparative Example 8 | B-8 | $8.97 \times 10^{-6}$ | $7.58 \times 10^{-8}$ | 118.3 | 37.5 | 86 | −50 | 40 |
| C | Comparative Example 9 | B-9 | $3.44 \times 10^{-7}$ | $5.82 \times 10^{-7}$ | 0.6 | 31.8 | 145 | −8 | 33 |
| | Example 12 | A-12 | $4.85 \times 10^{-7}$ | $3.98 \times 10^{-7}$ | 1.2 | 37.4 | 95 | −2 | 24 |
| | Example 13 | A-13 | $1.61 \times 10^{-6}$ | $1.09 \times 10^{-7}$ | 14.8 | 36.9 | 84 | −1 | 23 |
| | Example 14 | A-14 | $4.52 \times 10^{-6}$ | $1.09 \times 10^{-7}$ | 41.3 | 37.5 | 82 | −8 | 24 |
| | Comparative Example 10 | B-10 | $5.84 \times 10^{-6}$ | $9.71 \times 10^{-8}$ | 60.2 | 38.0 | 80 | −16 | 30 |
| | Comparative Example 11 | B-11 | $8.97 \times 10^{-6}$ | $6.82 \times 10^{-8}$ | 131.5 | 37.8 | 78 | −45 | 44 |
| Example 15 | | A-15 | $1.61 \times 10^{-6}$ | $1.34 \times 10^{-7}$ | 12.1 | 36.7 | 89 | −2 | 23 |
| Example 16 | | A-16 | $1.61 \times 10^{-6}$ | $1.15 \times 10^{-7}$ | 14.0 | 36.4 | 92 | −3 | 24 |
| Example 17 | | A-17 | $1.61 \times 10^{-6}$ | $1.07 \times 10^{-7}$ | 15.1 | 37.0 | 82 | −1 | 22 |
| Example 18 | | A-18 | $1.61 \times 10^{-6}$ | $1.12 \times 10^{-7}$ | 14.4 | 36.2 | 95 | −4 | 25 |
| Example 19 | | A-19 | $5.22 \times 10^{-7}$ | $2.74 \times 10^{-7}$ | 1.9 | 34.1 | 105 | −8 | 21 |
| Example 20 | | A-20 | $5.10 \times 10^{-7}$ | $2.67 \times 10^{-7}$ | 1.9 | 38.1 | 92 | −3 | 22 |
| Example 21 | | A-21 | $4.98 \times 10^{-7}$ | $2.61 \times 10^{-7}$ | 1.9 | 44.8 | 90 | −2 | 24 |
| Comparative Example 12 | | B-12 | $2.76 \times 10^{-6}$ | $5.06 \times 10^{-8}$ | 54.5 | 45.8 | 88 | −49 | 35 |

The photosensitive members (A-1) to (A-21) each included a conductive substrate and a photosensitive layer. The photosensitive layer was a single-layer photosensitive layer and contained a charge generating material, a hole transport material, an electron transport material(s), and a binder resin. As for each of the photosensitive members (A-1) to (A-21), the hole mobility $\mu_h$ was at least $1.00\times10^{-7}$ cm²/V/second and the electron mobility $\mu_e$ was at least $4.00\times10^{-8}$ cm²/V/second in the photosensitive layer as measured under conditions of a temperature of 23° C. and an electric field intensity of $1.50\times10^5$ V/cm. As for each of the photosensitive members (A-1) to (A-21), the ratio ($\mu_h/\mu_e$) of the hole mobility $\mu_h$ to the electron mobility $\mu_e$ was at least 1.0 and no greater than 50.0. Accordingly, as evident from Table 3, the photosensitive members (A-1) to (A-21) were excellent in sensitivity, transfer memory inhibiting ability, and chargeability.

As for each of the photosensitive members (B-1) to (B-12), the ratio ($\mu_h/\mu_e$) of the hole mobility $\mu_h$ to the electron mobility $\mu_e$ in the photosensitive layer as measured under conditions of a temperature of 23° C. and an electric field intensity of $1.50\times10^5$ V/cm was less than 1.0 or greater than 50.0. Accordingly, as evident from Table 3, the photosensitive members (B-1) to (B-12) were poor in at least one of sensitivity, transfer memory inhibiting ability, and chargeability.

Through the above, the photosensitive members according to the present disclosure have been proven to be excellent in electrical characteristics.

The following describes the relationship between the electrical characteristics of each photosensitive member and the ratio ($\mu_h/\mu_e$) of the hole mobility $\mu_h$ to the electron mobility $\mu_e$ in the photosensitive layer therein in more detail. Graphs in FIGS. 4 to 6 respectively show a relationship between the mobility ratio ($\mu_h/\mu_e$) and the post-irradiation potential ($V_L$), a relationship between the mobility ratio ($\mu_h/\mu_e$) and the transfer memory potential ($\Delta V_{tc}$), and a relationship between the mobility ratio ($\mu_h/\mu_e$) and the charging current (Idc) for Groups A, B, and C shown in Table 3. In each of the graphs in FIGS. 4 to 6, the vertical axis represents post-irradiation potential ($V_L$), transfer memory potential ($\Delta V_{tc}$), or charging current (Idc), and the horizontal axis represents ratio ($\mu_h/\mu_e$).

Figure 4:
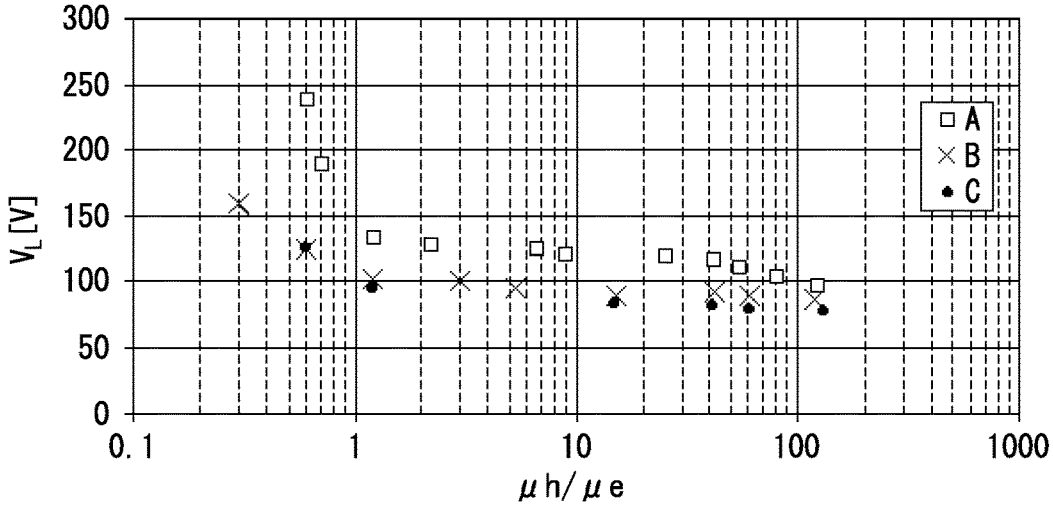
FIG. 4 is a graph showing a relationship between a post-irradiation potential ($V_L$) and a ratio ($\mu_h/\mu_e$) of a hole mobility $\mu_h$ to an electron mobility $\mu_e$ measured in Examples.

As apparent from FIG. 4, the post-irradiation potential ($V_L$) was substantially constant when the mobility ratio ($\mu_h/\mu_e$) was 1.0 or greater in the photosensitive layers in each group. However, the post-irradiation potential showed a tendency to significantly increase (that is, sensitivity showed a tendency to significantly decrease) when the mobility ratio ($\mu_h/\mu_e$) was less than 1.0.

Figure 5:
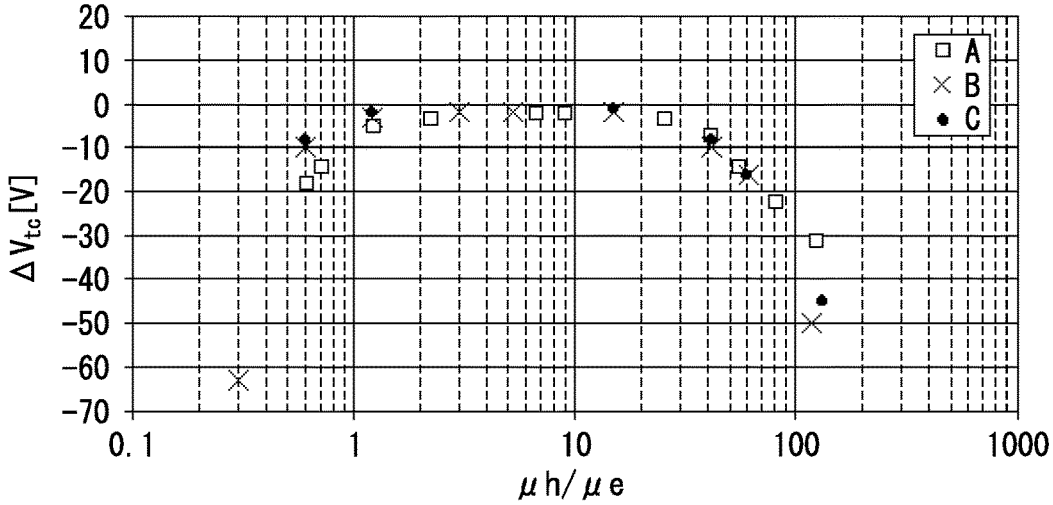
FIG. 5 is a graph showing a relationship between a transfer memory potential ($\Delta V_{tc}$) and the ratio ($\mu_h/\mu_e$) of the hole mobility $\mu_h$ to the electron mobility $\mu_e$ measured in Examples.

As apparent from FIG. 5, the transfer memory potential ($\Delta V_{tc}$) was substantially constant when the mobility ratio ($\mu_h/\mu_e$) was in a range of from 1.0 to 50.0 in the photosensitive layers in each group. However, the absolute value of the transfer memory potential showed a tendency to significantly increase (that is, transfer memory inhibiting ability showed a tendency to significantly decrease) when the mobility ratio ($\mu_h/\mu_e$) was less than 1.0 or greater than 50.0.

Figure 6:
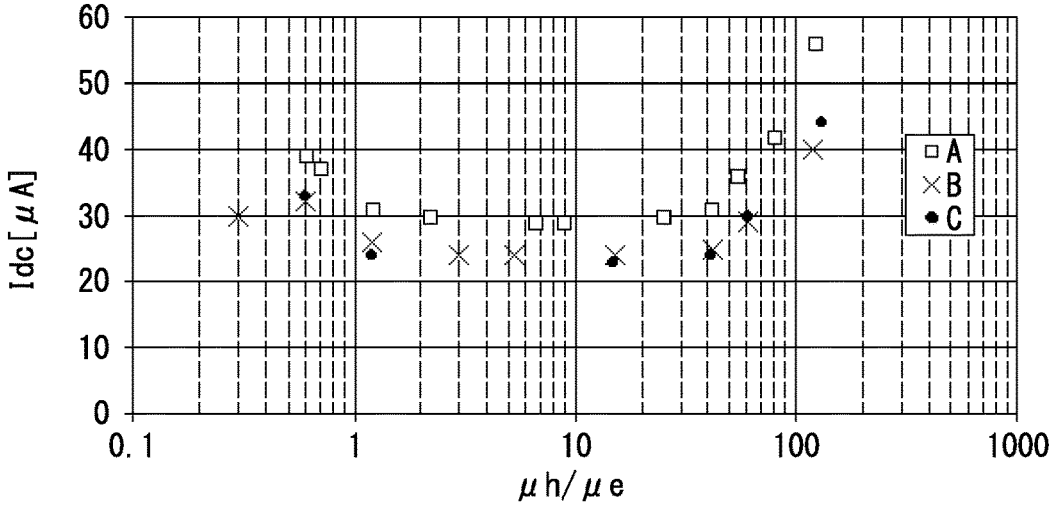
FIG. 6 is a graph showing a relationship between a charging current (Idc) and the ratio ($\mu_h/\mu_e$) of the hole mobility $\mu_h$ to the electron mobility $\mu_e$ measured in Examples.

As apparent from FIG. 6, the charging current (Idc) was substantially constant when the mobility ratio ($\mu_h/\mu_e$) was in a range of from 1.0 to 50.0 in the photosensitive layers in each group. However, the absolute value of the charging current showed a tendency to significantly increase (that is, chargeability showed a tendency to significantly decrease) when the mobility ratio ($\mu_h/\mu_e$) was less than 1.0 or greater than 50.0.

As described above, even photosensitive members having photosensitive layers containing the same charge generating material, the same hole transport material, and the same electron transport material(s) were significantly different from one another in sensitivity, transfer memory inhibiting ability, and chargeability depending on whether the mobility ratio ($\mu_h/\mu_e$) was within the numerical range of from 1.0 to 50.0 or outside the numerical range. This tendency was common to Groups A to C differing from one another in type of the charge transport material, the hole transport material, and the electron transport materials.

The above results have confirmed that the mobility ratio ($\mu_h/\mu_e$) in the photosensitive layers being at least 1.0 and no greater than 50.0 contributes to excellent electrical characteristics of the photosensitive members according to the present disclosure.

What is claimed is:

1. An electrophotographic photosensitive member comprising a conductive substrate and a photosensitive layer, wherein the photosensitive layer is a single-layer photosensitive layer and contains a charge generating material, a hole transport material, an electron transport material, and a binder resin, a hole mobility $\mu_h$ is at least $1.00\times10^{-7}$ $cm^2/V/second$ and an electron mobility $\mu_e$ is at least $4.00\times10^{-8}$ $cm^2/V/second$ in the photosensitive layer as measured under conditions of a temperature of 23° C. and an electric field intensity of $1.50\times10^5$ V/cm, a ratio ($\mu_h/\mu_e$) of the hole mobility $\mu_h$ to the electron mobility $\mu_e$ is at least 1.0 and no greater than 50.0, and the binder resin includes a polyarylate resin having a main chain represented by chemical formula (PA-1a) shown below and a terminal group represented by chemical formula (Z) shown below, (PA-1a)

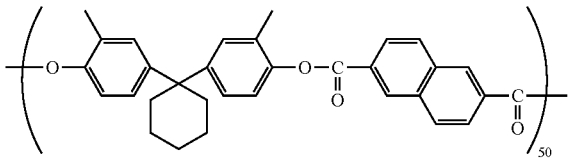

-continued

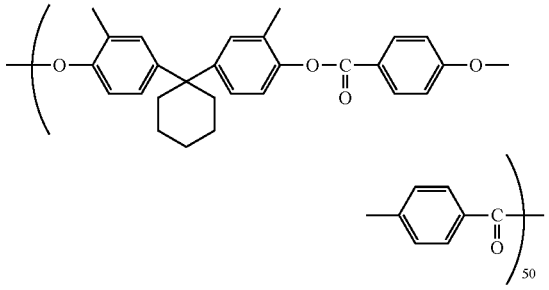

(Z)

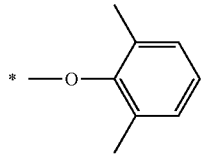

where in chemical formula (Z), an asterisk represents a bond.

2. The electrophotographic photosensitive member according to claim 1, wherein the ratio ($\mu_h/\mu_e$) of the hole mobility $\mu_h$ to the electron mobility $\mu_e$ is at least 1.0 and no greater than 10.0.

3. The electrophotographic photosensitive member according to claim 1, wherein the hole mobility $\mu_h$ and the electron mobility $\mu_e$ are each no greater than $1.00\times10^{-5}$ $cm^2/V/second$.

4. The electrophotographic photosensitive member according to claim 1, wherein the photosensitive layer contains the charge generating material in a proportion of at least 0.5% by mass and no greater than 2.0% by mass, and a xerographic gain in the photosensitive layer as measured under conditions of a temperature of 23° C. and an electric field intensity of $1.50\times10^5$ V/cm is at least 10% and no greater than 45%.

5. The electrophotographic photosensitive member according to claim 1, wherein the charge generating material includes a compound represented by chemical formula (CG-1) or (CG-2) shown below (CG-1)

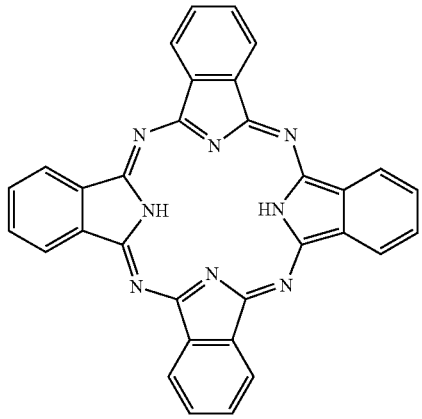

-continued (CG-2)

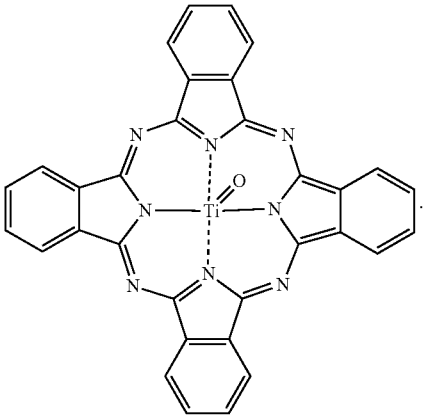

6. The electrophotographic photosensitive member according to claim 1, wherein the electron transport material includes a compound represented by general formula (1), (2), (3), or (4) shown below, (1)

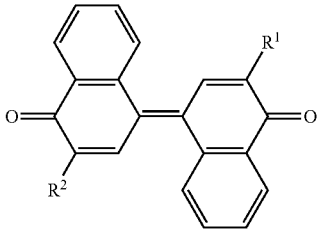

(2)

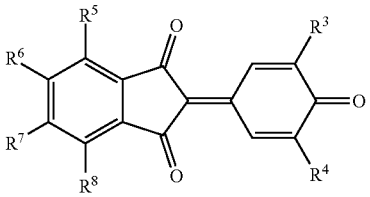

(3)

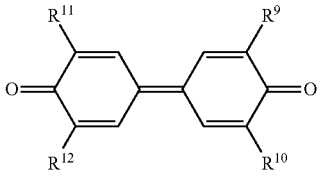

-continued (4)

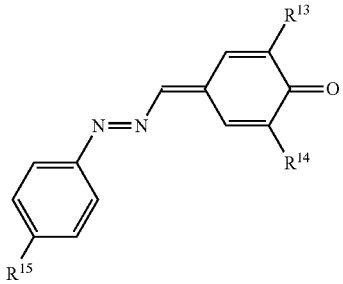

where in general formulae (1) to (4), $R^1$ to $R^4$ and $R^9$ to $R^{14}$ each represent, independently of one another, an alkyl group having a carbon number of at least 1 and no greater than 8, and $R^5$ to $R^8$ and $R^{15}$ each represent, independently of one another, a hydrogen atom, a halogen atom, or an alkyl group having a carbon number of at least 1 and no greater than 4.

7. The electrophotographic photosensitive member according to claim 6, wherein the compounds represented by general formulae (1), (2), (3), and (4) are compounds represented by chemical formulae (ET-1), (ET-2), (ET-3), and (ET-4) shown below (ET-1)

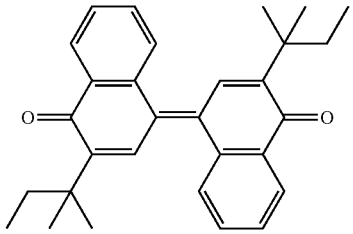

(ET-2)

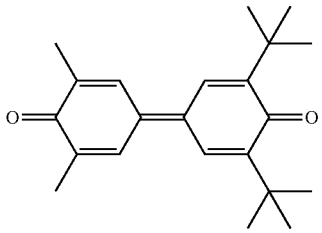

(ET-3)

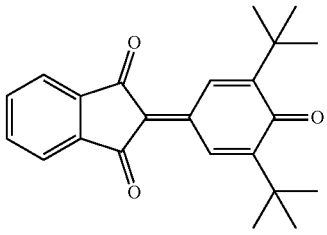

-continued (ET-4)

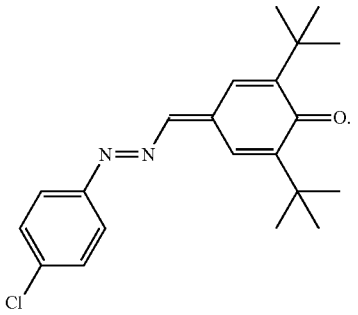

8. The electrophotographic photosensitive member according to claim 1, wherein the hole transport material includes a compound represented by general formula (10) shown below, (10)

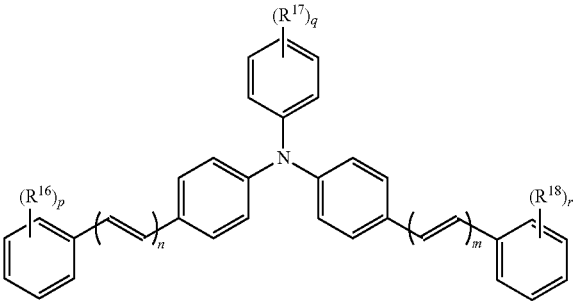

where in general formula (10), $R^{16}$ to $R^{18}$ each represent, independently of one another, an alkyl group having a carbon number of at least 1 and no greater than 4 or an alkoxy group having a carbon number of at least 1 and no greater than 4, m and n each represent, independently of one another, an integer of at least 1 and no greater than 3, p and r each represent, independently of one another, 0 or 1, and q represents an integer of at least 0 and no greater than 2.

9. The electrophotographic photosensitive member according to claim 8, wherein the compound represented by general formula (10) is a compound represented by chemical formula (HT-1) shown below

10. The electrophotographic photosensitive member according to claim 1, wherein the photosensitive layer contains the hole transport material in a proportion of at least 10.0% by mass and no greater than 40.0% by mass, and the photosensitive layer contains the electron transport material in a proportion of at least 10.0% by mass and no greater than 50.0% by mass.

11. The electrophotographic photosensitive member according to claim 1, wherein the hole transport material includes a compound represented by chemical formula (HT-1) shown below, the photosensitive layer contains the hole transport material in a proportion of at least 18.0% by mass and no greater than 32.0% by mass, the electron transport material includes a compound represented by chemical formula (ET-1) shown below, includes a compound represented by chemical formula (ET-2) shown below, includes a compound represented by chemical formula (ET-3) shown below, includes a compound represented by chemical formula (ET-4) shown below, includes the compound represented by chemical formula (ET-1) shown below and the compound represented by chemical formula (ET-2) shown below, or includes the compound represented by chemical formula (ET-1) shown below and the compound represented by chemical formula (ET-3) shown below, and the photosensitive layer contains the electron transport material in a proportion of at least 21.0% by mass and no greater than 33.0% by mass (HT-1)

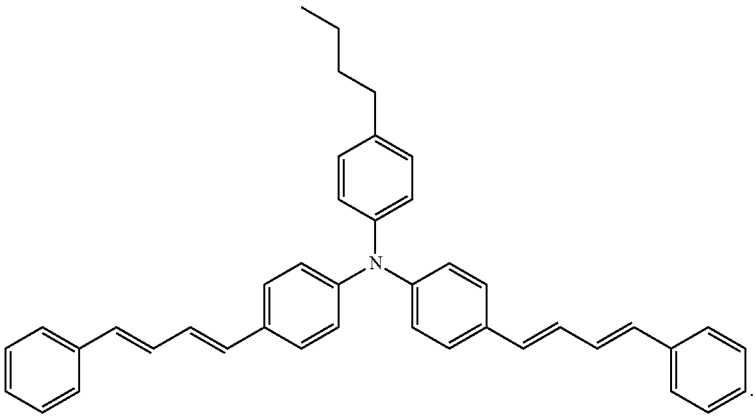

(HT-1)
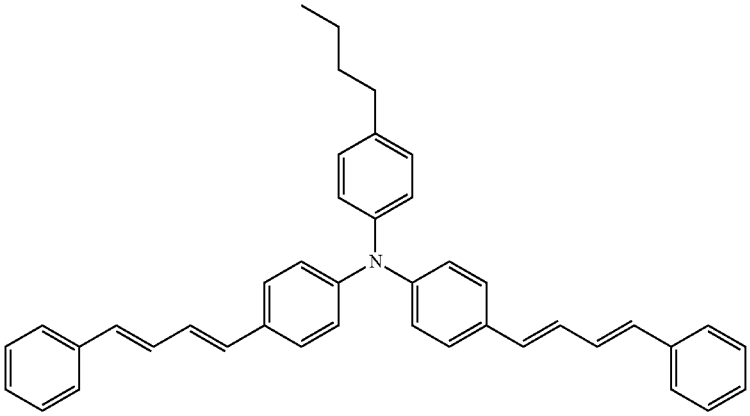
(ET-1)
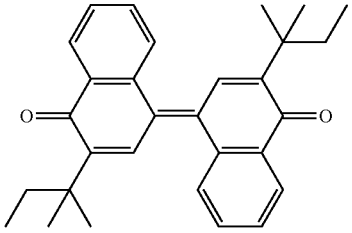
(ET-2)
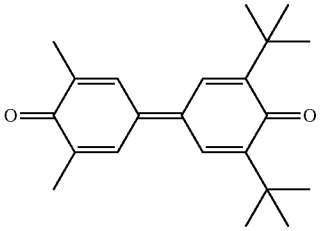
(ET-3)
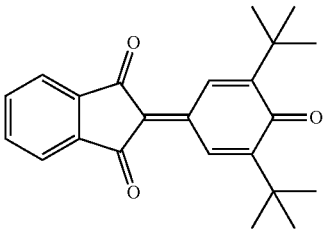
(ET-4)
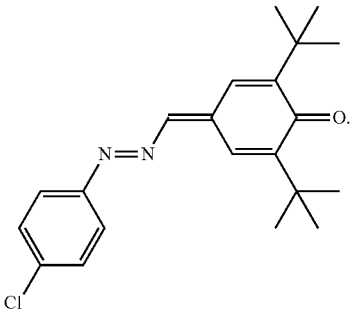
* * * * *